US011229819B1

(12) United States Patent
Olson

(10) Patent No.: US 11,229,819 B1
(45) Date of Patent: Jan. 25, 2022

(54) DUMBBELL SYSTEM

(71) Applicant: Gregory Olson, Owatonna, MN (US)

(72) Inventor: Gregory Olson, Owatonna, MN (US)

( * ) Notice: Subject to any disclaimer, the term of this patent is extended or adjusted under 35 U.S.C. 154(b) by 0 days.

(21) Appl. No.: 17/173,331

(22) Filed: Feb. 11, 2021

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01)

(58) Field of Classification Search
CPC ..... A63B 21/0726; A63B 21/072–075; A63B 21/0628–0632; A63B 21/0004; A63B 21/00058; A63B 21/06–607; A63B 21/062–0632; A63B 21/4023
See application file for complete search history.

(56) References Cited

U.S. PATENT DOCUMENTS 4,787,628 A 11/1988 Harwick
5,046,725 A * 9/1991 Brennan ..... A63B 23/16 482/50
D359,778 S 6/1995 Towley, III
6,083,144 A 7/2000 Towley, III
6,149,558 A * 11/2000 Chen ..... A63B 21/0728 482/107
6,196,952 B1 * 3/2001 Chen ..... A63B 21/0728 482/107
6,461,282 B1 10/2002 Fenelon
6,896,645 B1 5/2005 Krull
7,014,598 B2 3/2006 Fenelon
7,025,713 B2 4/2006 Dalebout
7,153,244 B2 12/2006 Towley, III
7,335,145 B2 2/2008 Towley, III
7,387,596 B2 6/2008 Towley, III
7,491,155 B2 2/2009 Fenelon
7,520,845 B2 4/2009 Towley, III
7,549,952 B2 6/2009 Towley, III
7,563,208 B1 7/2009 Chen
7,578,771 B1 8/2009 Towley, III
7,722,511 B2 5/2010 Towley, III
7,731,640 B1 6/2010 Chen
7,762,933 B1 7/2010 Yu
7,771,330 B2 8/2010 Towley, III
7,775,947 B2 8/2010 Towley, III
7,850,581 B2 12/2010 Towley, III
7,854,693 B2 12/2010 Towley, III
7,857,735 B2 12/2010 Towley, III
7,878,952 B2 2/2011 Fenelon
(Continued)

*Primary Examiner* — Jennifer Robertson
*Assistant Examiner* — Catrina A Letterman

(57) ABSTRACT

A dumbbell system a plurality of weights vertically stackable on top of each other and each of the weights has a pair of outer edges disposed oppositely from each other to define a first lateral edge and a second lateral edge. The weights each have a centrally displaced opening vertically extending therethrough and defining a receiving space. The receiving space of each weight is vertically aligned with the receiving space of each of the other weights. A handle is removably extendable into the receiving space. A coupler releasably engages a selected one of the weights to the handle and defines a coupled weight. The coupled weight and each of the weights positioned above the coupled weight is releasably secured to the handle. Each of the weights positioned below the coupled weight are disengaged from the handle.

19 Claims, 14 Drawing Sheets

(56) References Cited

U.S. PATENT DOCUMENTS

| | | | | |
|---|---|---|---|---|
| 7,918,772 | B2 | 4/2011 | Towley, III | |
| D644,701 | S | 9/2011 | Towley, III | |
| 8,012,069 | B2 | 9/2011 | Towley, III | |
| D651,672 | S | 1/2012 | Towley, III | |
| D652,877 | S | 1/2012 | Dalebout | |
| 8,157,711 | B2 | 4/2012 | Towley, III | |
| D664,613 | S | 7/2012 | Dalebout | |
| 8,267,841 | B1 | 9/2012 | Allison | |
| 8,394,004 | B2 | 3/2013 | Towley, III | |
| 8,668,630 | B2 | 3/2014 | Towley, III | |
| 8,771,153 | B2 | 7/2014 | Dalebout | |
| 9,011,300 | B2 | 4/2015 | Modes | |
| 9,022,906 | B1 | 5/2015 | Nelson | |
| 9,132,312 | B2 | 9/2015 | Henley | |
| 9,446,283 | B2 | 9/2016 | Nelson | |
| 9,616,270 | B2 | 4/2017 | Towely | |
| 9,795,823 | B2 | 10/2017 | Wyncott | |
| 10,035,037 | B2 | 7/2018 | Towley | |
| 10,086,225 | B2 | 10/2018 | Sheppard | |
| 10,099,083 | B1 | 10/2018 | Owusu | |
| 10,166,429 | B2 | 1/2019 | Chen | |
| 10,463,906 | B2 | 11/2019 | Owusu | |
| 10,786,700 | B2 | 9/2020 | Owusu | |
| 2007/0087918 | A1* | 4/2007 | Towley, III | A63B 21/075 482/107 |
| 2007/0135274 | A1 | 6/2007 | Blateri | |
| 2008/0081744 | A1 | 4/2008 | Gormley | |
| 2011/0028285 | A1* | 2/2011 | Towley, III | A63B 21/0728 482/108 |
| 2011/0312475 | A1* | 12/2011 | Towley, III | A63B 21/0726 482/107 |
| 2012/0264575 | A1* | 10/2012 | Towley, III | A63B 21/0726 482/107 |
| 2015/0105224 | A1 | 4/2015 | Odneal | |
| 2016/0236029 | A1 | 8/2016 | Kaszer | |
| 2017/0056703 | A1 | 3/2017 | Phelps | |
| 2017/0209731 | A1* | 7/2017 | Towley, III | A63B 23/12 |
| 2018/0140888 | A1* | 5/2018 | Towley, III | A63B 71/0036 |
| 2019/0344113 | A1 | 11/2019 | Tran | |
| 2019/0344114 | A1 | 11/2019 | Tran | |
| 2020/0147440 | A1* | 5/2020 | Towley, III | A63B 21/075 |

* cited by examiner

DUMBBELL SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to modular weight device and more particularly pertains to a new modular weight device for allowing a person to alter the mass of an exercising weight and more particularly for a dumbbell. The device herein allows a person to add or remove weights to the dumbbell such that the overall mass of the dumbbell is selectively alterable.

(2) Description of Related Art Including Information Disclosed Under 37 CFR 1.97 and 1.98

The prior art relates to modular weight devices whereby a person is provided with a set of weight elements that are removable from, or attachable to, a grip such that overall mass of the weight device is adjustable as needed.

BRIEF SUMMARY OF THE INVENTION

An embodiment of the disclosure meets the needs presented above by generally comprising a plurality of weights that are vertically stackable on top of each other. Each of the weights has a pair of outer edges disposed oppositely from each other and define a first lateral edge and a second lateral edge. The weights each have a centrally displaced opening vertically extending therethrough and defining a receiving space. The receiving space of each weight is vertically aligned with the receiving space of each of the other weights. A handle is removably extendable into the receiving space. A coupler releasably engages a selected one of the weights to the handle and defines a coupled weight. The coupled weight and each of the weights positioned above the coupled weight is releasably secured to the handle. Each of the weights positioned below the coupled weight are disengaged from the handle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
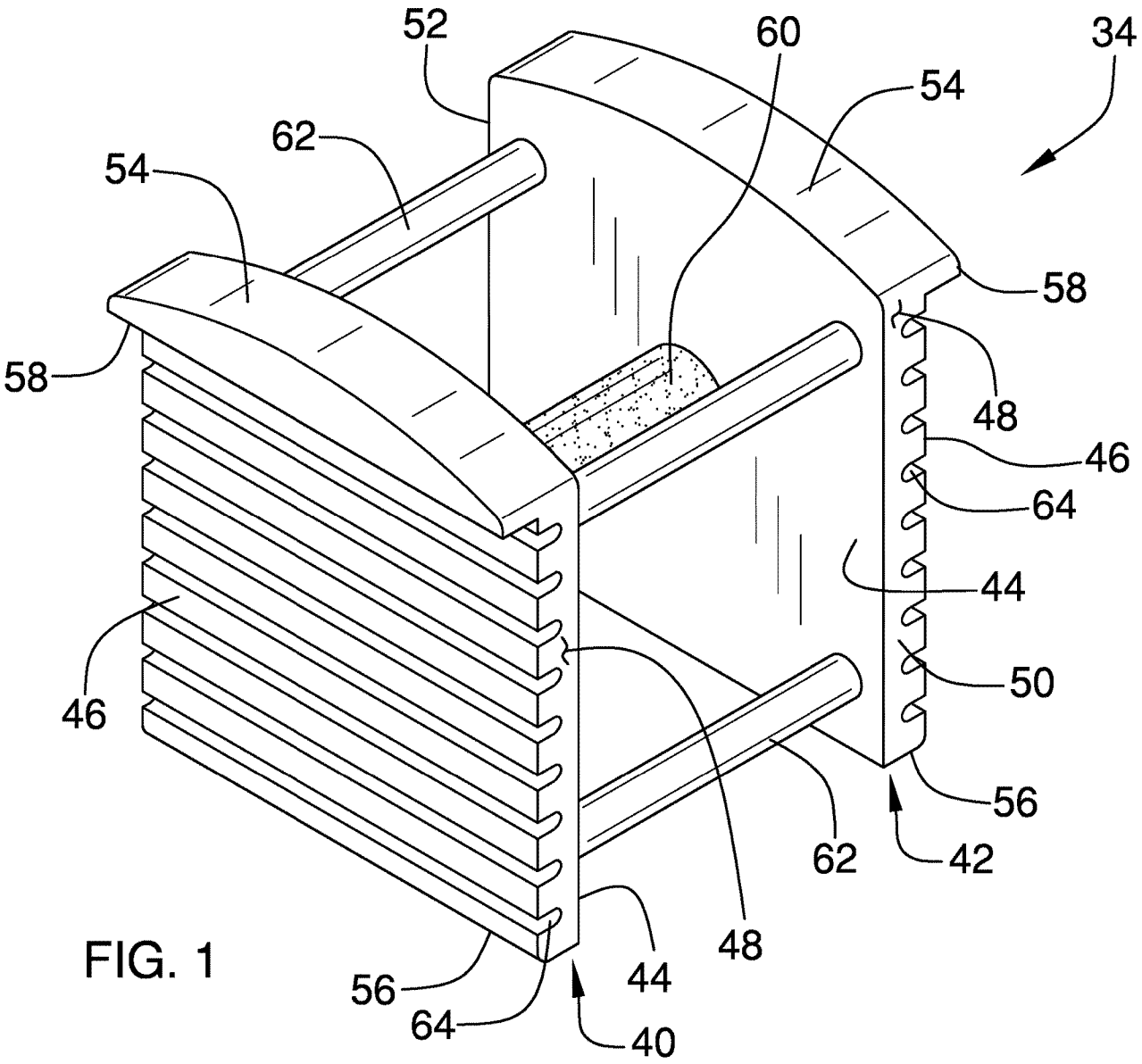
FIG. 1 is a front isometric view of a handle of a dumbbell system according to an embodiment of the disclosure.

With reference now to the drawings, and in particular to FIGS. 1 through 14 thereof, a new modular weight device embodying the principles and concepts of an embodiment of the disclosure and generally designated by the reference numeral 10 will be described.

As best illustrated in FIGS. 1 through 14, the dumbbell system 10 generally comprises a plurality of weights 12 that are vertically stackable on top of each other. There term "stackable" herein has the definition of each weight being supported by the weight positioned directly there-below. Thus, when the system 10 of the plurality of weights 12 is placed on a surface, a bottommost one of the weights 12 will be the only weight 12 abutting the surface while each successive stacked weight will be farther from the surface than the weight 12 upon which it rests. As another example, the center of mass of each weight 12 will be positioned higher than the weight 12 upon which it is stacked.

Figure 7:
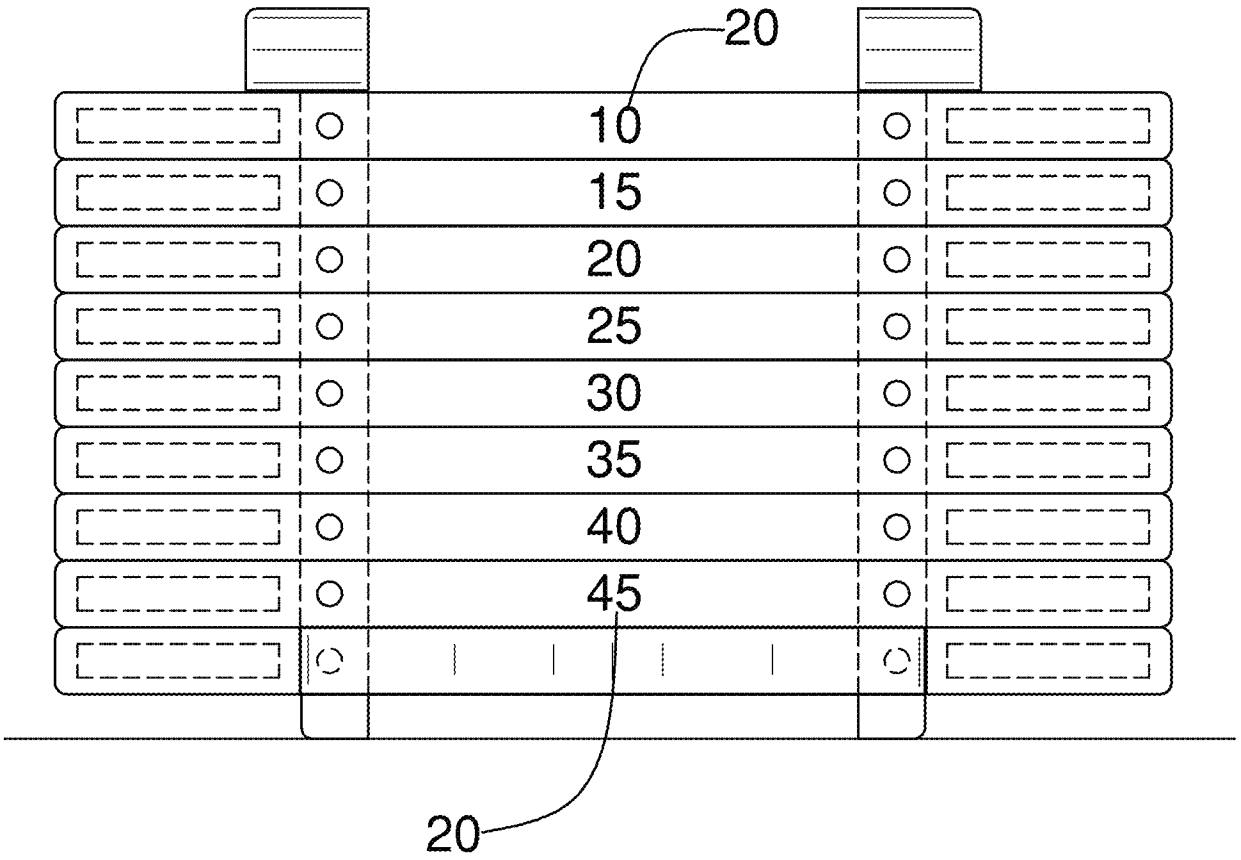
FIG. 7 is a front view of an embodiment of the disclosure.
Figure 8:
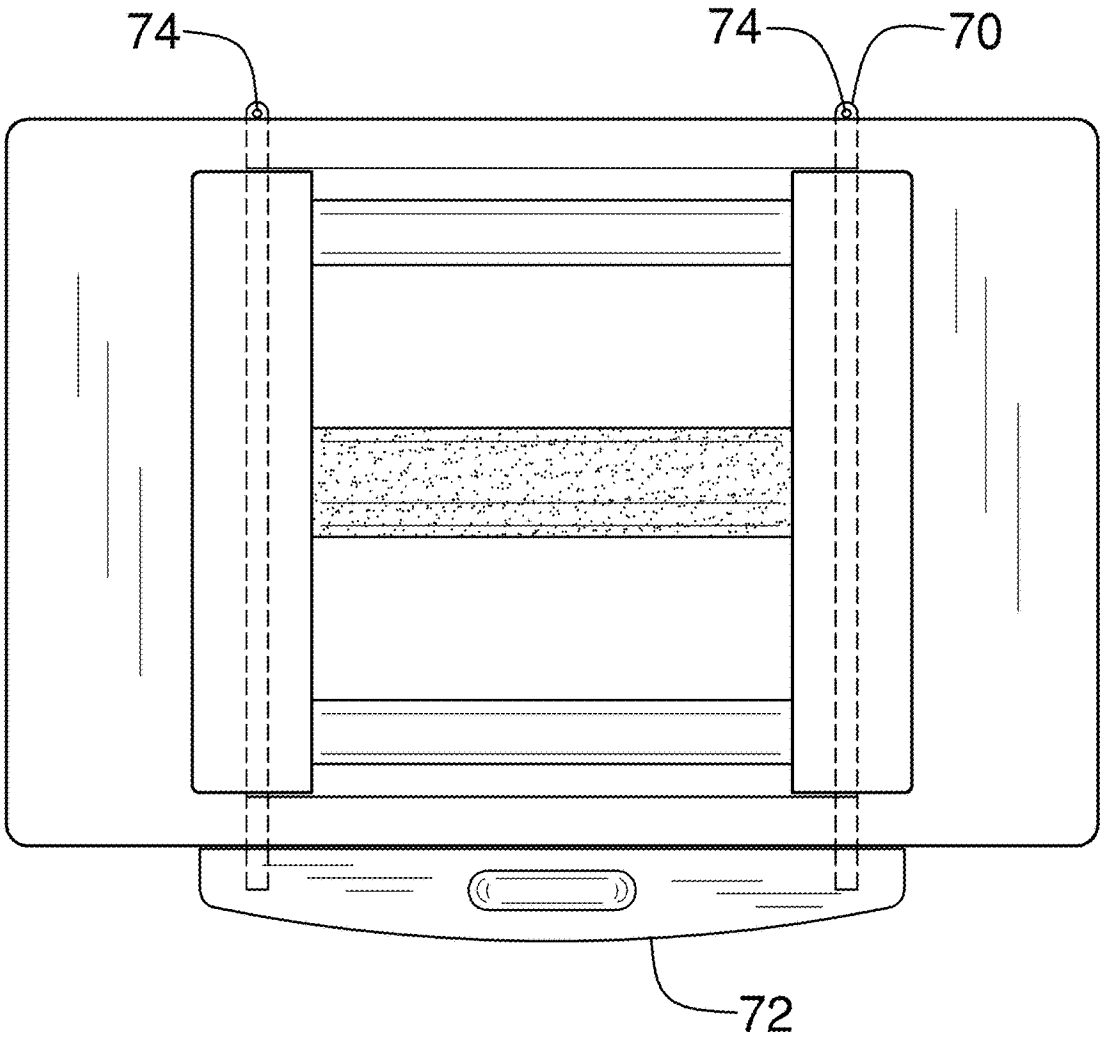
FIG. 8 is a top isometric view of an embodiment of the disclosure.
Figure 9:
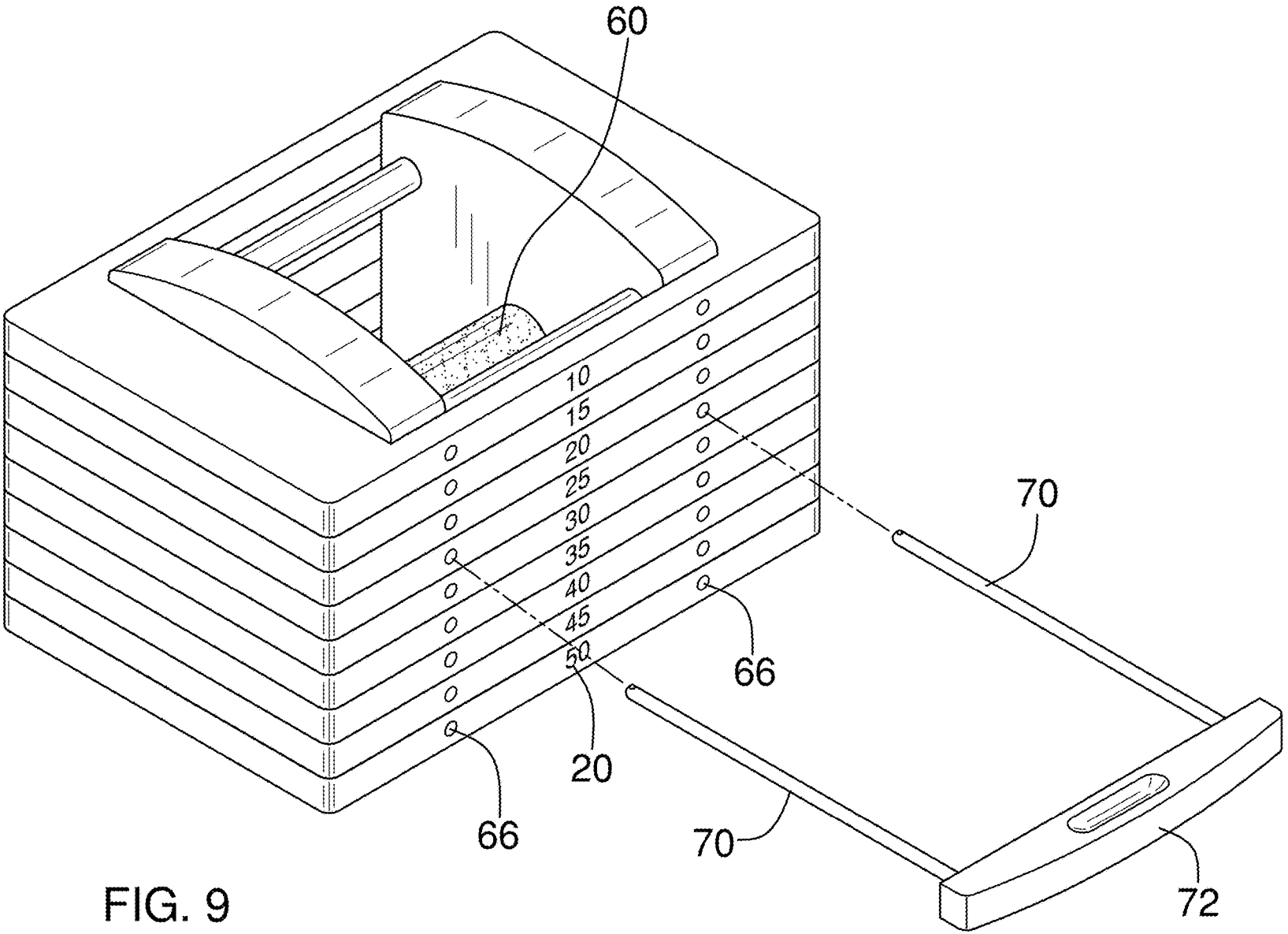
FIG. 9 is a front isometric view of an embodiment of the disclosure.
Figure 10:
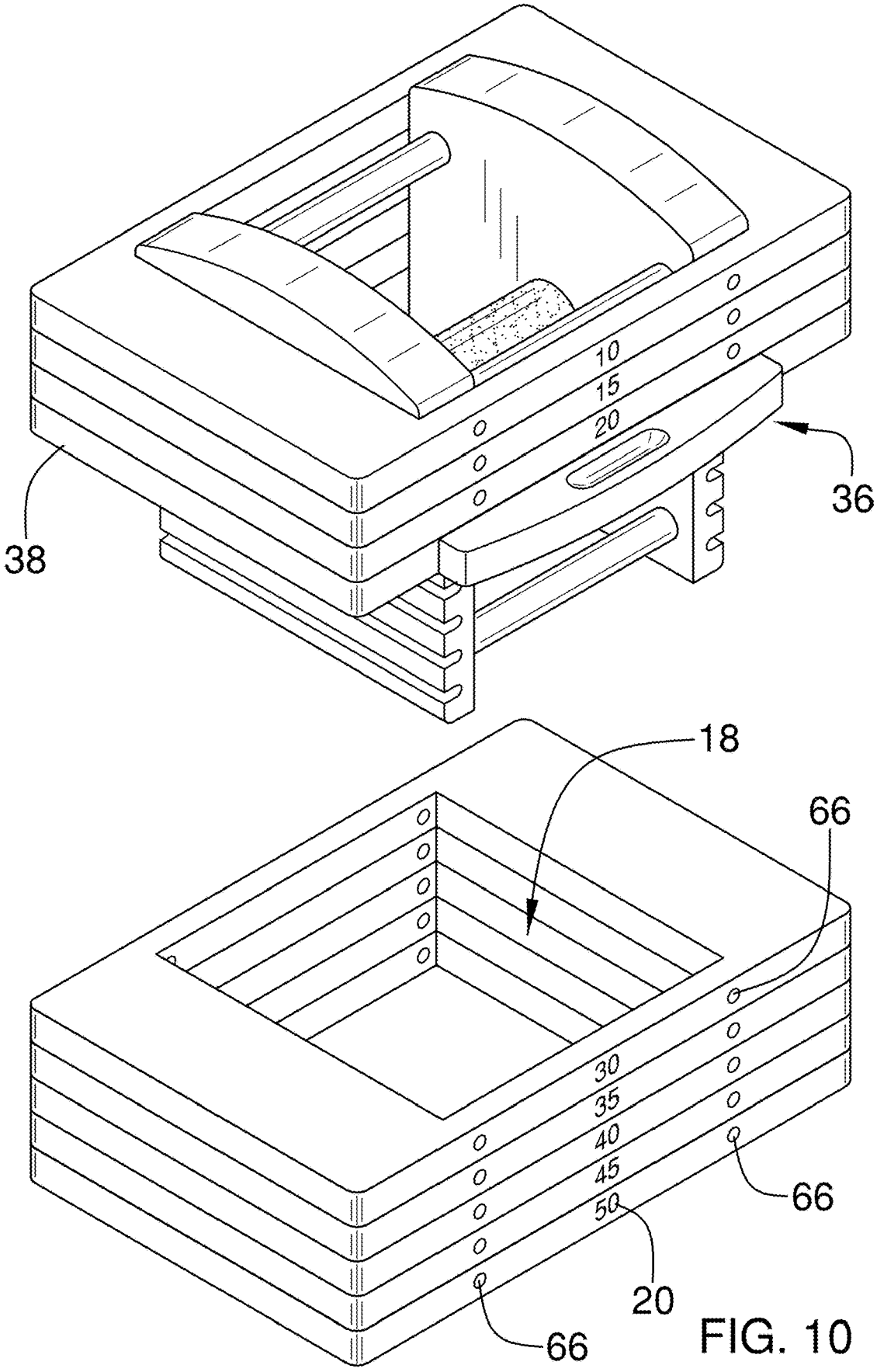
FIG. 10 is a front isometric view of an embodiment of the disclosure.
Figure 11:
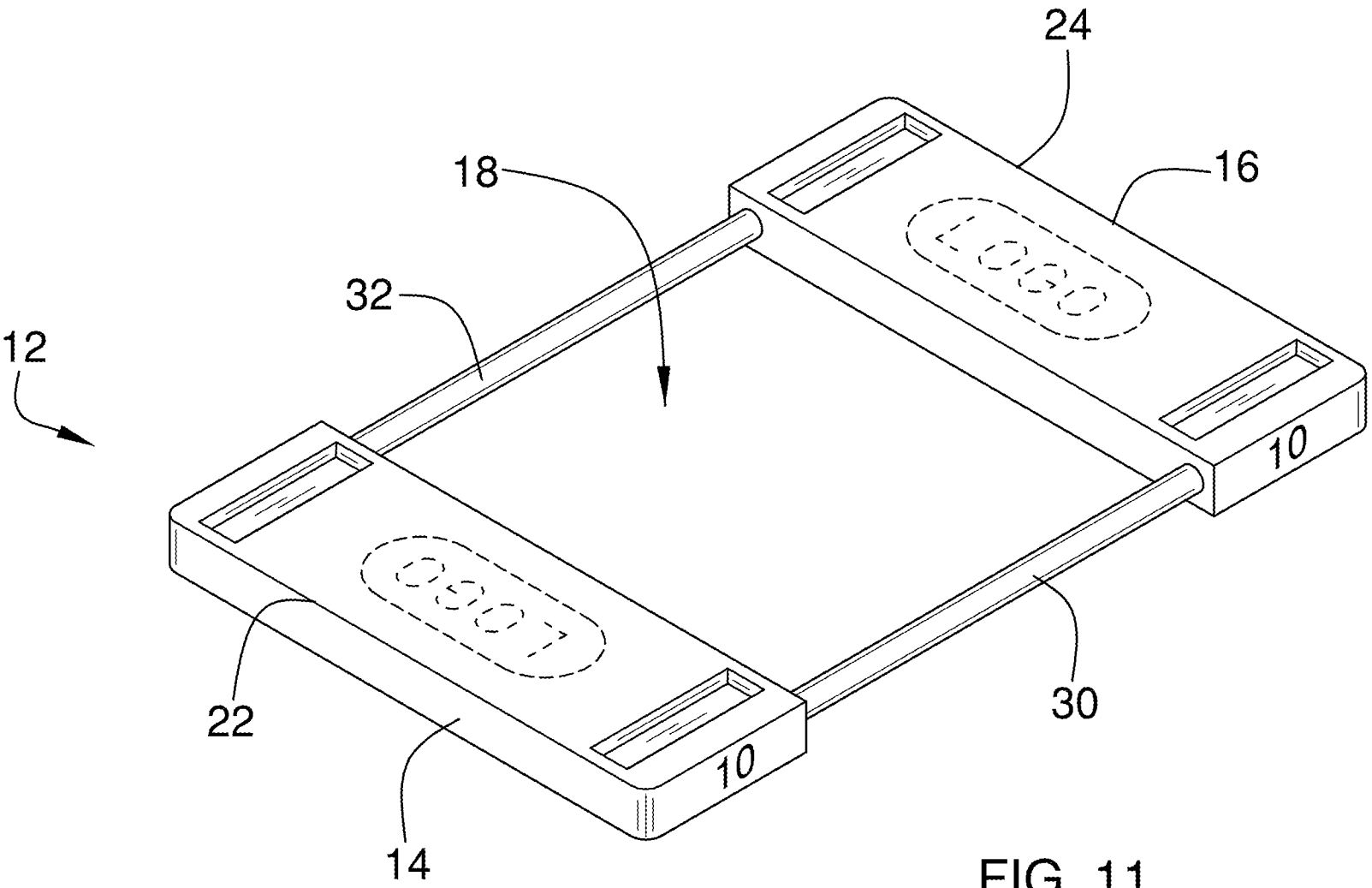
FIG. 11 is a front isometric view of an embodiment of the disclosure.
Figure 12:
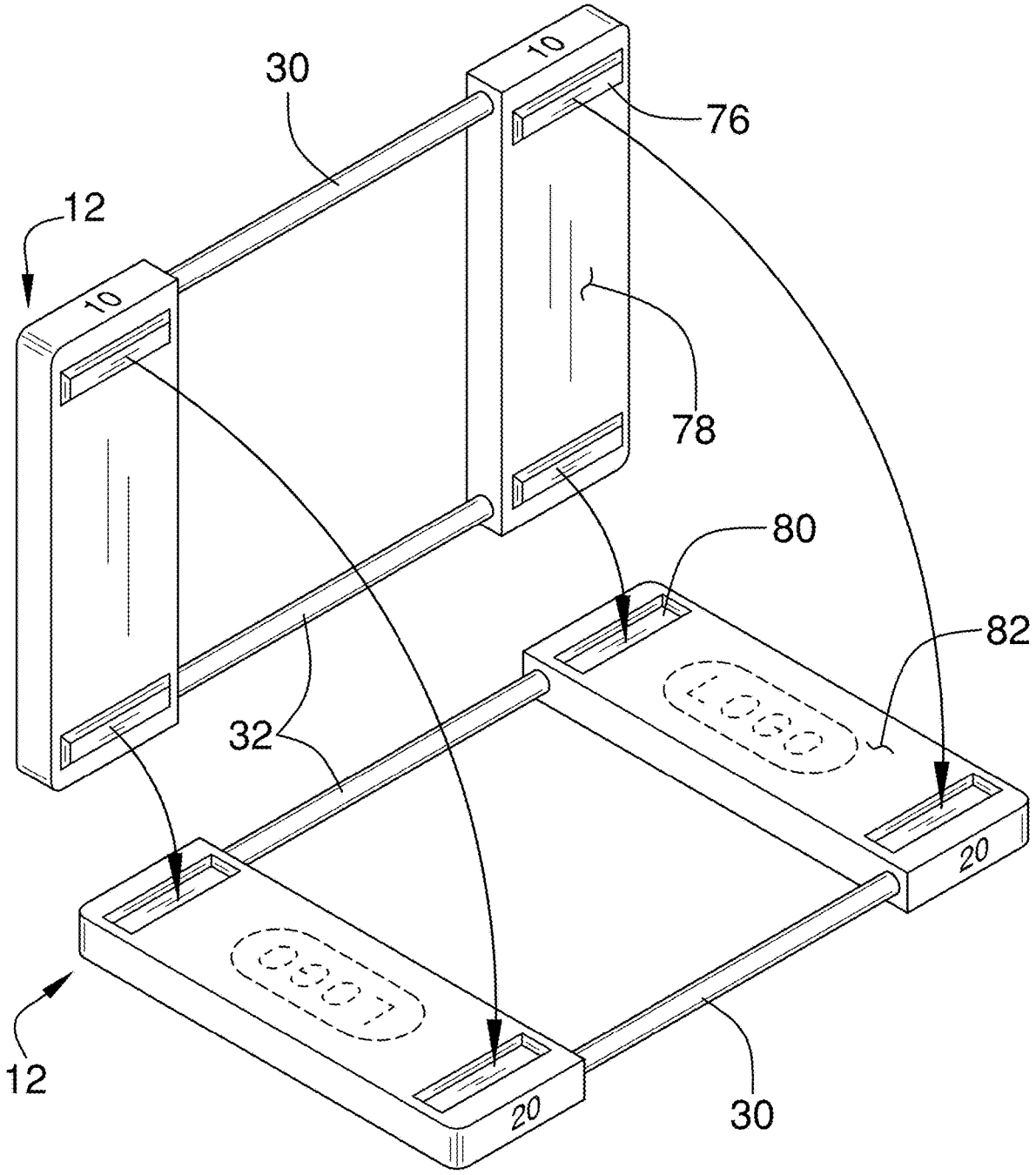
FIG. 12 is a front isometric view of the embodiment of FIG. 11 of the disclosure.
Figure 13:
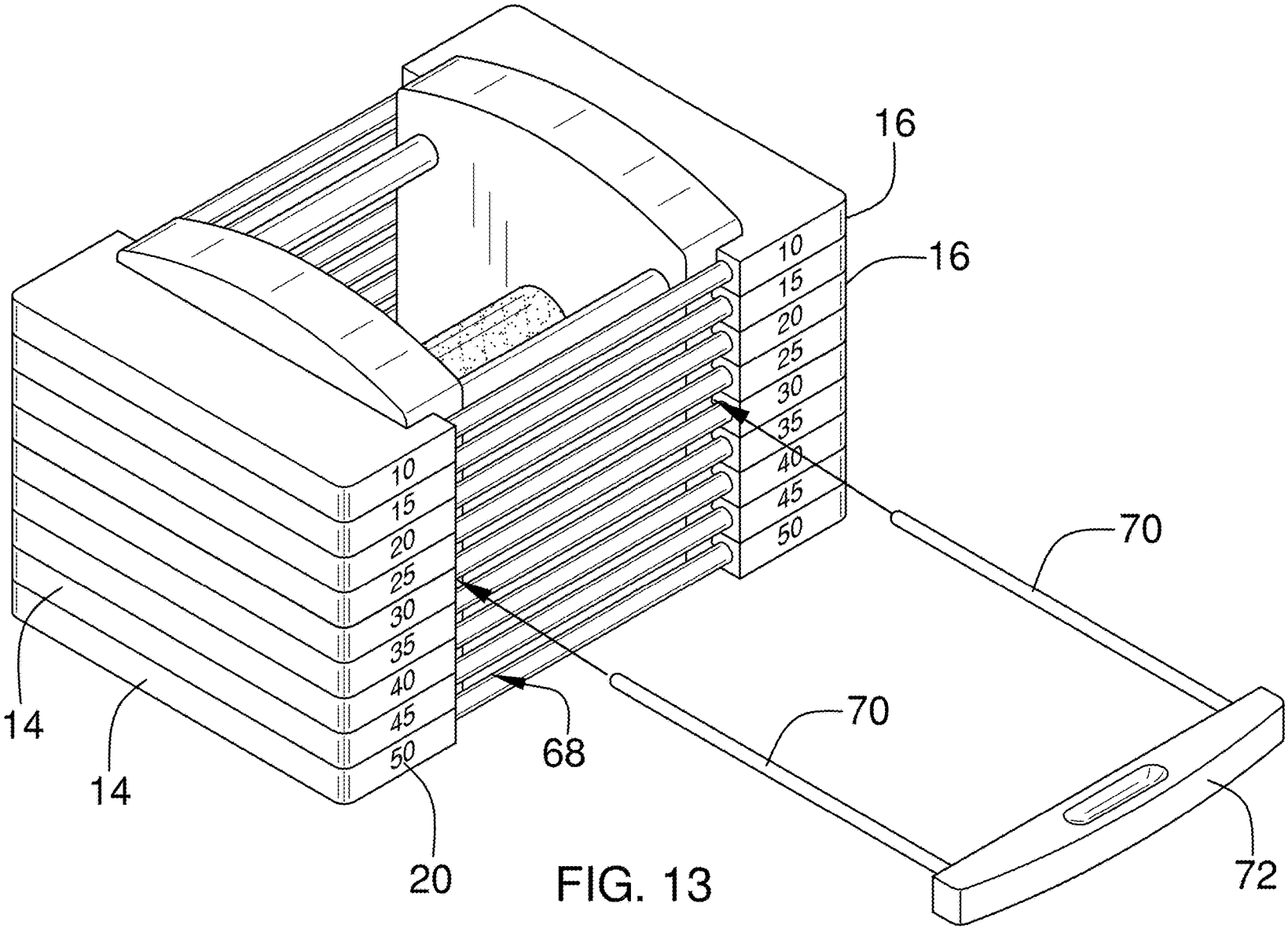
FIG. 13 is a front isometric view of the embodiment of FIG. 11 of the disclosure.

Each of the weights 12 has a pair of outer edges disposed oppositely from each other to define a first lateral edge 14 and a second lateral edge 16. The weights 12 each have a centrally displaced opening vertically extending therethrough to define a receiving space 18. The receiving space 18 of each weight 12 is vertically aligned with the receiving space 18 of each of the other weights 12. The weights 12 may each weigh the same and if using English units may weigh for example, 2.5 lbs., 5.0 lbs., 10.0 lbs. or other typical weight increment found in the weight lifting arts. Should metric units of weights be desired, each weight may be equal to 1.0 kg, 2.5 kg, 5.0 kg, or other conventional weight increments. While the weights 12 will typically all have a same weight defining a standard weight, some embodiments may include one or two weights 12 which are either half or double the standard weight. The cumulative weight of the weights 12 may be indicated by indicia 20 as shown in FIG. 7. However, the indicia 20 instead of displaying numbers may comprise, or also include, color coding to indicate cumulative weight. It should be noted that an uppermost one of the weights 12 may include indicia 12 that is not in a regular increment as the remaining ones of the weights 12. The embodiment of FIG. 7 displays increments of 5.0 lbs. though the uppermost weight begins with 10.0 lbs. This is indicative of other elements of the system 10 being secured to the uppermost one of the weights 12 as will be more fully understood below.

In some embodiments, a distance between the first 14 and second 16 lateral edges of an uppermost one of the plurality of weights 12 is equal to or greater than the distance between the first 14 and second 16 lateral edges of the other weights 12. As such, when viewed from above, only the uppermost one of the weights 12 is viewable. Moreover, the first lateral edges 14 may be aligned with each other and the second lateral edges 16 aligned with each other, as shown in FIG. 7, such that the first lateral edges 14 are aligned with a first vertical plane and the second lateral edges 16 are aligned with a second vertical plane. The weights 12 may each have an identical shape with respect to each other and having linear first 14 and second 16 lateral edges. However, first 14 and second 16 lateral edges may be formed with varying shapes. Alternatively, the distance from the first 14 and second 16 lateral edges of the uppermost one of the weights may be equal to the distance between the first 14 and second 16 lateral edges of only some of the weights 12 should the stack of weights 12 have lateral edges, as a whole, which are staggered. In such embodiments a lowermost one of the weights 12 may be viewable from above the system 10. Other embodiments may include the distance between the first 14 and second 16 lateral edges decreases from the uppermost one of the weights 12 to a lowermost one of the weights 12, or this distance increases from the uppermost one of the weights to the lowermost one of the weights.

More particularly, each of the weights 12 includes a pair of plates 22, 24 spaced laterally from each other. One of the plates 22 including the first lateral edge 14 and one of the plates 24 includes the second lateral edge 16. The plates 22, 24 are each horizontally orientated and lie in a common horizontal plane with respect to each other. While the plates 22, 24 may instead be arcuate, from the receiving space 18 to a corresponding first 14 or second 18 lateral edge, a planar shape would typically be more efficient in construction. The plates 22, 24, as shown in the Figures, may include an internal mass 26 comprising a metal, such as iron, or other high density material which is then encapsulated in a coating 28 of a shock absorbent, scuff-resistant material such as plastics, elastomers and the like.

Figure 4:
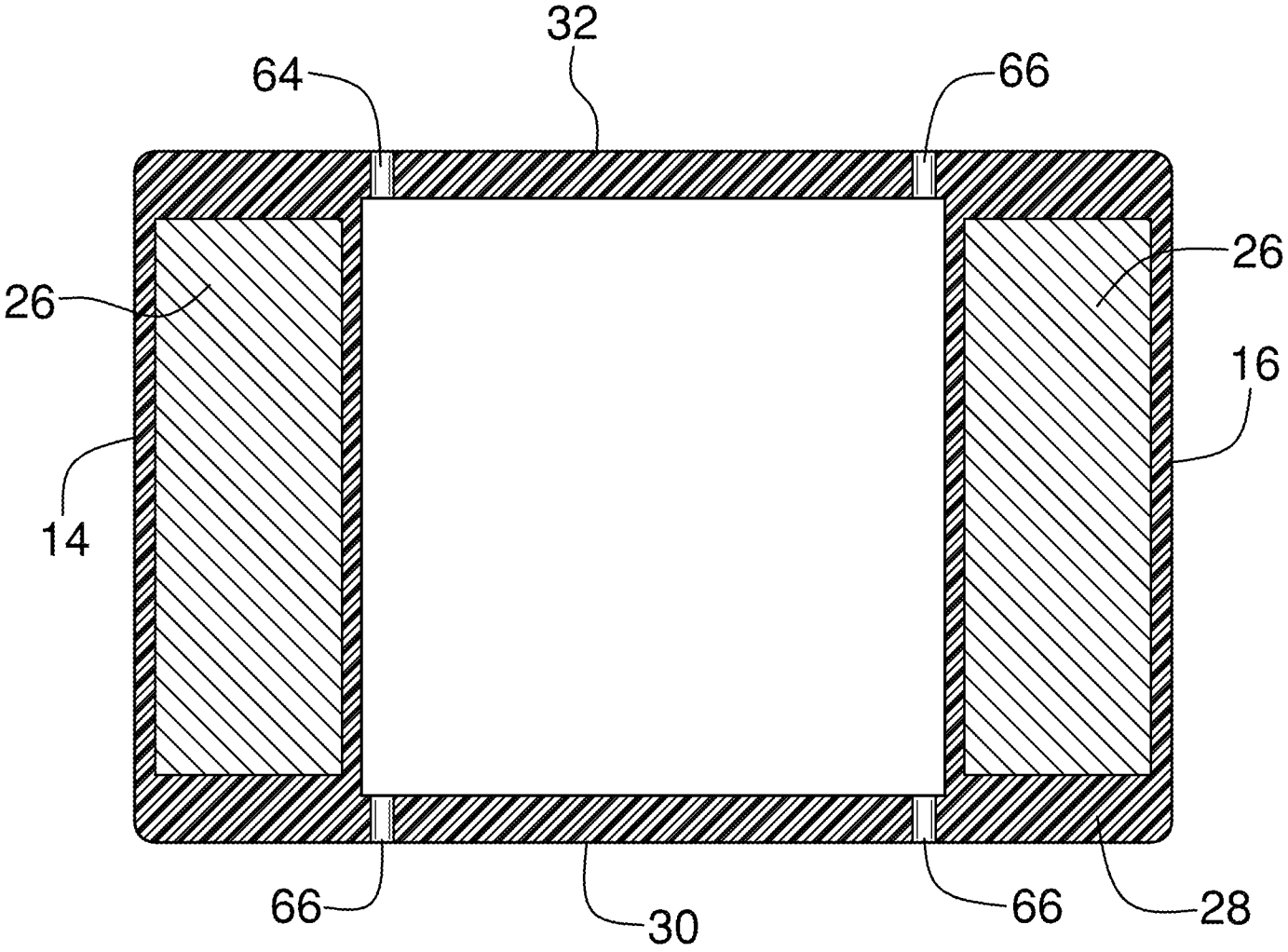
FIG. 4 is a cross-sectional view of an embodiment of the disclosure taken along line 4-4 of FIG. 2.
Figure 5:
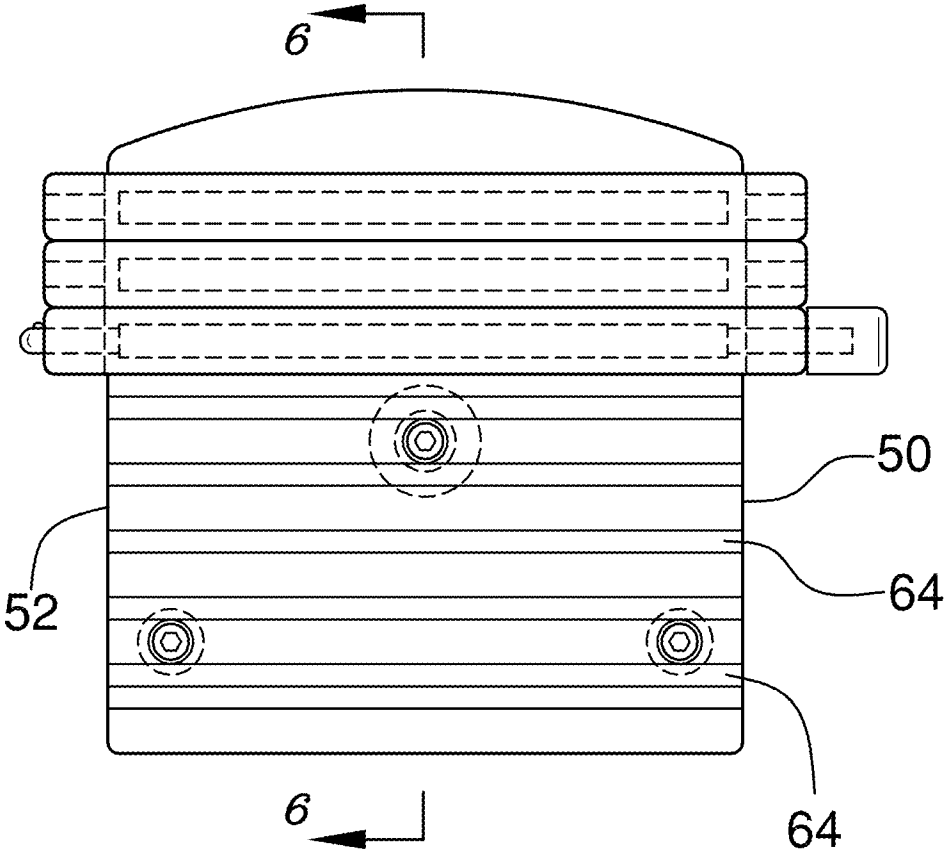
FIG. 5 is a side view of an embodiment of the disclosure.

A pair of arms 30, 32 is each attached to and extends between the plates 22, 24. The receiving space 18 is defined and is bound by the plates 22, 24 and the arms 30, 32. The arms 30, 32 may be covered with the coating 28 such that the weight 12 appears as a unitary structure. The arms 30, 32 may be comprised of a slightly flexible material for shock absorbing purposes though rigid materials, such as metals may be utilized. The method of coupling the arms 30, 32 to the plates 22, 24 is not crucial to the system 10. Thus, the arms 30, 32 may be secured to the plates 22, 24 using conventional couplers including screws, or formed from the coating 28 itself, as is shown in FIG. 4. Alternatively, the arms 30, 32 may be mechanically coupled to the internal mass such as by welding, fasteners and the like, and the coating 28, if used, may be applied after the arms 30, 32 are secured to the internal mass 26.

A handle 34 is removably extendable into the receiving space 18 and is securable to selected ones of the weights 12 to allow the system 10 to function as a dumbbell. A coupler 36 releasably engages a selected one of the weights 12 to the handle 34 and defines a coupled weight 38. The coupled weight 38 and each of the weights 12 positioned above the coupled weight 38 is releasably secured to the handle 34 and each of the weights 12 positioned below the coupled weight 38 are disengaged from the handle 34. In this manner, the user can select the number of weights 12 to be supported on the handle 34 and thereby be usable weight for a particular exercise.

In an embodiment shown in the Figures and in particular FIG. 1, the handle 34 includes a first lateral panel 40 and a second lateral panel 42. Each of the first 40 and second 42 lateral panels is vertically orientated. The first 40 and second 42 lateral panels each have an inner surface 44, an outer surface 46 and a perimeter edge 48. The perimeter edge 48 includes a front edge 50 and a rear edge 52 positioned oppositely of each other, as well as a top edge 54 and bottom edge 56. The top edges 54 may each include a shoulder 58 wherein the shoulders 58 extend in opposite directions with respect to each other to extend over the weights 12. The shoulders 58 form stops to stabilize the weights 12 between the shoulders 58 and coupler 36 when the system 10 is being used during different exercises. Materials used for the first 40 and second 42 lateral panels may be varied but will typically include high strength, generally rigid materials formed of plastics or metals.

Figure 6:
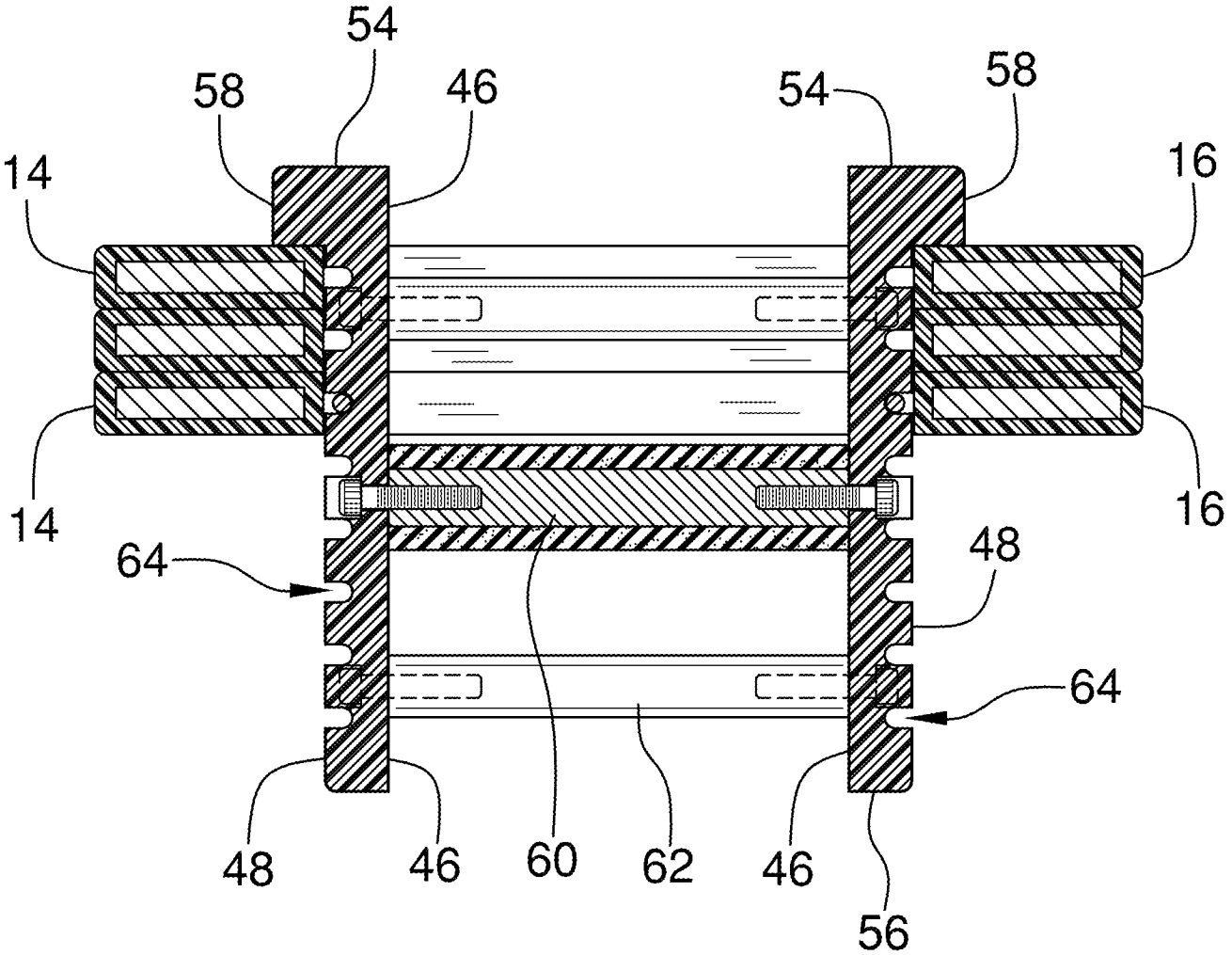
FIG. 6 is a cross-sectional view of an embodiment of the disclosure taken along line 6-6 of FIG. 5.

A grip 60 is attached to and extends between the inner surfaces 44 of the first 40 and second 42 lateral panels. The grip 60 will typically be centrally located on the first 40 and second 42 lateral panels and secured in such a manner that the perimeter edges 48 of the first 40 and second 42 lateral panels is aligned with each other. As can be seen in FIG. 6, the grip 60 may include multiple components such as a central post of rigid material that is coated in a grip enhancing material which may also have resiliently compressible characteristics. Elastomers and foams may be preferred grip enhancing materials. While FIG. 6 shows the grip 60 secured to the first 40 and second 42 lateral panels, the grip may be formed as a unitary structure with the first 40 and second 42 lateral panels and thereafter, if desired, furnished with the grip enhancing material. A plurality of stabilizing rods 62 may extend between and be attached to the first 40 and second 42 lateral panels to stabilize the first 40 and second 42 lateral panels relative to each other. While the rods 62 may include four rods 62 as shown in the Figures, some embodiments may only include a pair of rods 62 positioned near the bottom edge 56.

The front edges 50 each have a plurality of receivers 64 therein that are disposed in vertical alignment with each other. Each of the receivers 64 in one of the front edges 50 is horizontally aligned with one of the receivers 64 in the other one of the front edges 50 to define a pair of receivers 64. The receivers 64 are positioned such that each pair of receivers 64 is aligned with one of the weights 12 as is best shown in FIG. 6. The receivers 64 may comprise a tunnel extending through an entirety of the first 40 and second 42 lateral panels and outwardly through the rear edges 52. Alternatively, as can be seen in the Figures, the receivers 64 may comprise horizontally orientated grooves positioned in the outer surfaces 46 where the grooves extend through the front 50 and rear 52 edges.

Figure 2:
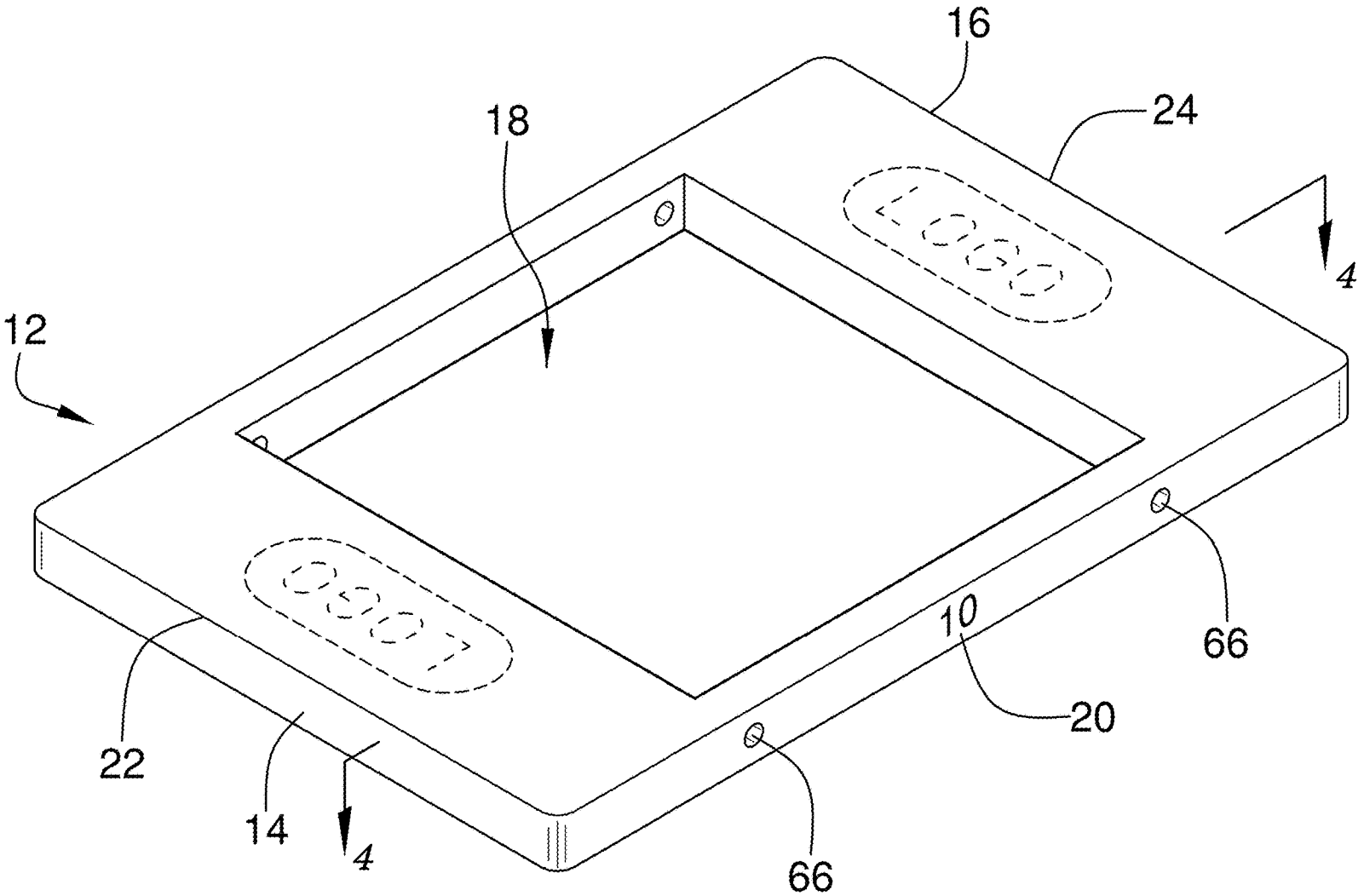
FIG. 2 is a top isometric view of a weight of an embodiment of the disclosure.
Figure 3:
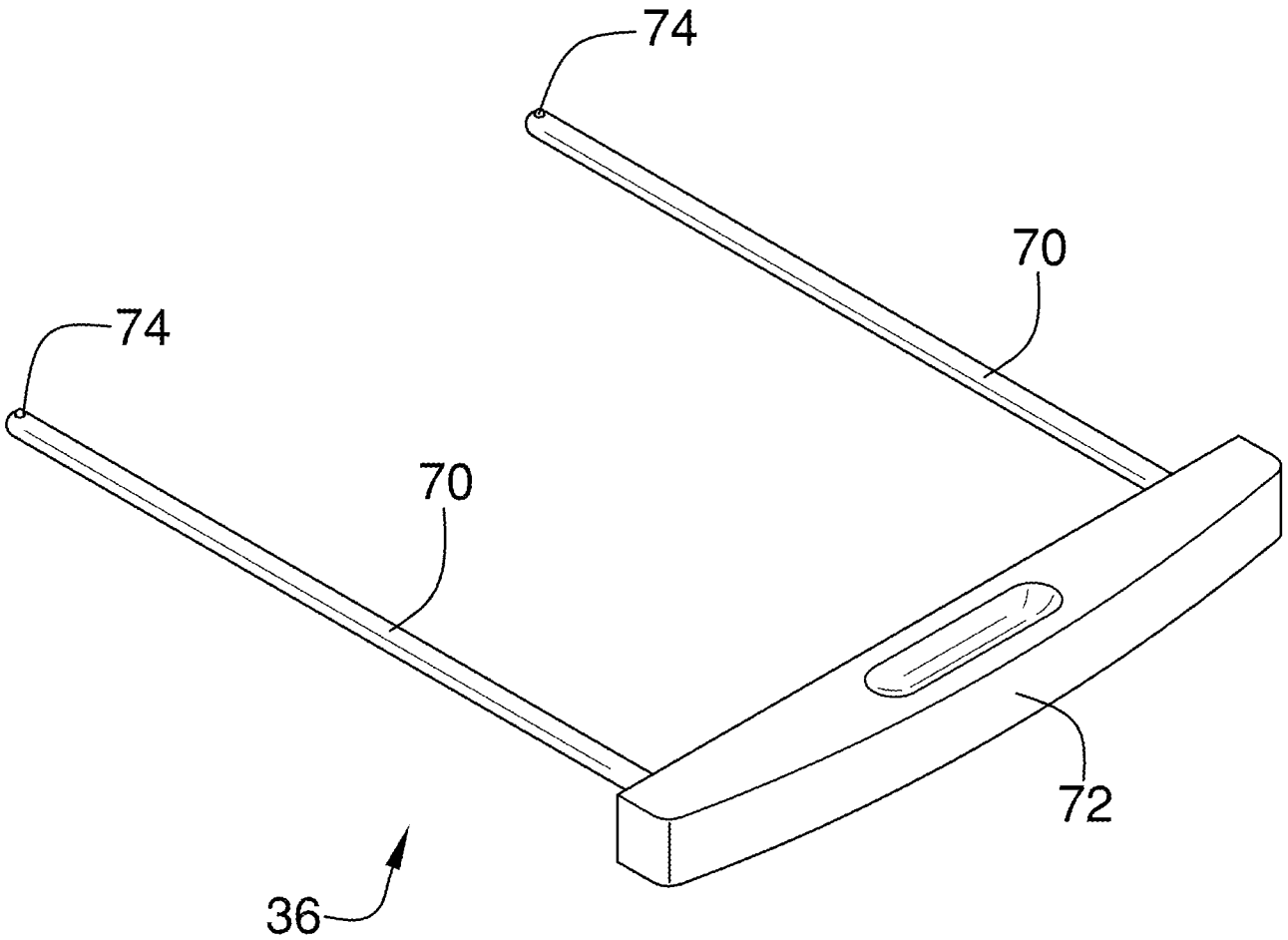
FIG. 3 is a top isometric view of a coupler of an embodiment of the disclosure.

For descriptive purposes and as best shown in FIGS. 2 and 4, in one embodiment the arms front 30, 32 of the weights 12 each include a front arm 30 and a rear arm 32 wherein the front arm 30 is positioned adjacent to the front edges 50 of the first 40 and second 42 lateral panels. The front arm 30 and rear arm 32 of each of the weights 12 may each include a pair of apertures 66 wherein each of the apertures 66 is aligned with one of the receivers 64 such that a pair of channels is defined each including one aperture 66 in the front arm 30, one receiver 64, and one aperture in the rear arm 34.

Figure 14:
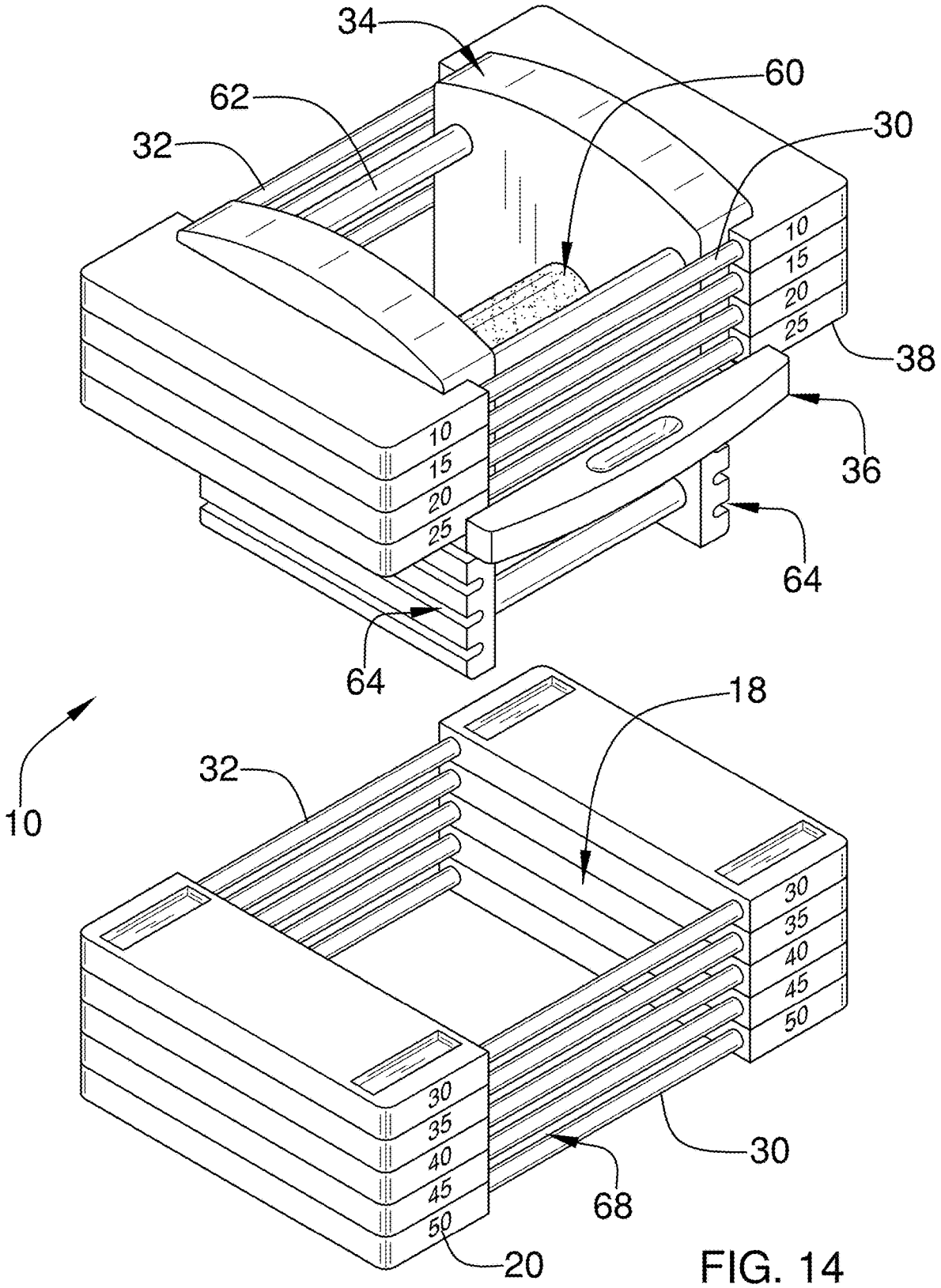
FIG. 14 is a front isometric view of the embodiment of FIG. 11 of the disclosure.

In another embodiment, shown in FIGS. 11-14, the front 30 and rear 32 arms do not include apertures 66. However, a gap 68 is formed between adjacent ones of front arms 30 and adjacent ones of the rear arms 32. This allows the coupler to extend under the front 30 and rear 32 arms of a selected one of the weights 12 to allow the coupler to engage the receivers. The front 30 and rear 32 arms are then seated upon the coupler as is shown in FIG. 14.

The coupler 36 may include a pair of tines 70 attached to a handhold 72. The tines 70 are extendable through the apertures 66 in one of the front arms 30 and aligned ones of the receivers 64 and thereafter through the aligned apertures 66 in the associated one of the rear arms 32. Alternatively, the tines are extended under the front 30 and rear 32 arms of a selected weight while engaging the associated one of the receivers 34. The weight 12 engaged with the tines 70 defines the coupled weight 38. As should be understood in the Figures, all weights 12 positioned above the tines 70 are secured to the in place between the coupled weight 38 and the shoulders 58. The coupler 36 may include features that prevent its accidentally sliding out of the receivers 64. For example, one such structure may include detents 74 positioned on the tines 70 distal to the handhold 72. Yet another retaining featured may include the handhold 72 and/or front arms 30 incorporating magnetic elements retaining the handhold 72 in abutment with the weights 12, or mating members on the handhold 72 and weight may frictionally or snappily engage each other. Alternatively, elastic cordage, attached to the coupler 36, may be utilized to continuously pull the coupler 36 into an engaged condition with the handle 34.

To prevent the weights 12 from sliding off of each other while stacked, the weights may include mating members with a first mating member 76 positioned on a lower surface 78 of each weight 12 and a second mating member 80 positioned on an upper surface 82 of each weight 12. In one embodiment shown in FIG. 12, the first 76 and second 80 mating members may include mating raised and trough sections.

In use, when the grip 60 is lifted, the handle 34, coupler 36, coupled weight 38 and all weights 12 there above are lifted upwardly such that the weights 12 below the coupled weight 38 are left behind. In this manner the user can select the total weight to be used for a particular exercise. The system 10 will be therefore be useful for all exercises dumbbells are commonly used for using one system 10 to take the place of numerous individual dumbbells.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A stacked weight system comprising:

a plurality of weights being vertically stackable on top of each other, each of the weights having a pair of outer edges disposed oppositely from each other and defining a first lateral edge and a second lateral edge, the weights each having a centrally displaced opening vertically extending therethrough and defining a receiving space, the receiving space of each weight being vertically aligned with the receiving space of each of the other weights;

a handle being removably extendable into the receiving space;

a coupler releasably engaging a selected one of the weights to the handle and defining a coupled weight, wherein the coupled weight and each of the weights positioned above the coupled weight being releasably secured to the handle, wherein each of the weights positioned below the coupled weight are disengaged from the handle; and wherein each of the weights includes a pair of plates spaced laterally from each other, one of the plates including the first lateral edge and one of the plates including the second lateral edge, the plates being horizontally orientated and lying in a common horizontal plane, and a pair of arms each being attached to and extending between the plates, the receiving space being defined and being bound by the plates and the arms.

2. The stacked weight system according to claim 1, wherein a distance between the first and second lateral edges of an uppermost one of the plurality of weights is equal to or greater than a distance between the first and second lateral edges of the other weights.

3. The stacked weight system according to claim 1, wherein a distance between the first and second lateral edges of an uppermost one of the plurality of weights is equal to or greater than a distance between the first and second lateral edges of at least two of the other weights.

4. The stacked weight system according to claim 2, wherein the first lateral edges are aligned with each other and the second lateral edges are aligned with each other such that the first lateral edges are aligned with a first vertical plane and the second lateral edges are aligned with a second vertical plane.

5. The stacked weight system according to claim 1, wherein the first lateral edges are aligned with each other and the second lateral edges are aligned with each other such that the first lateral edges are aligned with a first vertical plane and the second lateral edges are aligned with a second vertical plane.

6. The stacked weight system according to claim 1, wherein the handle includes:

a first lateral panel and a second lateral panel, each of the first and second lateral panels being vertically orientated, each of the first and second lateral panels having an inner surface, an outer surface and a perimeter edge, wherein the perimeter edge includes a front edge and a rear edge positioned oppositely of each other; and a grip being attached to and extending between the inner surfaces of the first and second lateral panels, the grip being centrally located on the first and second lateral panels, the perimeter edges of the first and second lateral panels being aligned with each other.

7. The stacked weight system according to claim 6, wherein the front edges each having a plurality of receivers therein being disposed in vertical alignment with each other and releasably engageable with the coupler.

8. The stacked weight system according to claim 7, wherein:

each of the receivers in one of the front edges being horizontally aligned with one of the receivers in the other one of the front edges to define a pair of receivers, each pair of receivers being aligned with one of the weights;

the arms of the weights each including a front arm and a rear arm;

the coupler including a pair of tines attached to a handle, the tines being engageable with each of the front and rear arms of one of the weights and an associated pair of the receivers.

9. The stacked weight system according to claim 8, Wherein the front and rear arms of each of the weights includes a pair of openings, each of the openings in the front and rear arms being aligned with one of the receivers, the tines being extendable through the openings in an associated one of the front and rear arms.

10. The stacked weight system according to claim 8, wherein the front and rear arms of each of the weights are positioned above the associated pair of receivers, Wherein the tines are extended under and abut the front and rear arms to be engaged by the tines.

11. The stacked weight system according to claim 8, wherein a distance between the first and second lateral edges of an uppermost one of the plurality of weights is equal to or greater than the distance between the first and second lateral edges of the other weights.

12. The stacked weight system according to claim 11, wherein the first lateral edges are aligned with each other and the second lateral edges being aligned with each other such that the first lateral edges are aligned with a first vertical plane and the second lateral edges are aligned with a second vertical plane.

13. The stacked weight system according to claim 8, wherein the first lateral edges are aligned with each other and the second lateral edges are aligned with each other such that the first lateral edges are aligned with a first vertical plane and the second lateral edges are aligned with a second vertical plane.

14. The stacked weight system according to claim 13, wherein the front and rear arms of each of the weights includes a pair of openings, each of the openings in the front and rear arms being aligned with one of the receivers, the tines being extendable through the openings in an associated one of the front and rear arms.

15. The stacked weight system according to claim 13, wherein the front and rear arms of each of the weights are positioned above the associated pair of receivers, wherein the tines are extended under and abut the front and rear arms to be engaged by the tines.

16. A stacked weight system comprising:

a plurality of weights being vertically stackable on top of each other, each of the weights having a pair of outer edges disposed oppositely from each other and defining a first lateral edge and a second lateral edge, the weights each having a centrally displaced opening vertically extending therethrough and defining a receiving space, the receiving space of each weight being vertically aligned with the receiving space of each of the other weights;

a handle being removably extendable into the receiving space, the handle including grip positioned within the receiving space, the grip being elongated in a horizontal direction, one of the weights defining an uppermost weight and one of the weights defining a lowermost weight, the uppermost weight being vertically spaced completely above the lowermost weight and the grip, the lowermost weight being vertically spaced completely below the uppermost weight and the grip; and a coupler releasably engaging a selected one of the weights to the handle and defining a coupled weight, wherein the coupled weight and each of the weights positioned above the coupled weight are releasably secured to the handle, wherein each of the weights positioned below the coupled weight are disengaged from the handle.

17. The stacked weight system according to claim 16, wherein a distance between the first and second lateral edges of the uppermost one of the plurality of weights is equal to a distance between the first and second lateral edges of at least some of the other weights.

18. The stacked weight system according to claim 16, wherein a distance between the first and second lateral edges of at least one of the weights is equal to a distance between the first and second lateral edges of at least some of the other weights.

19. The stacked weight system according to claim 16, wherein the handle includes:

a first lateral panel and a second lateral panel, each of the first and second lateral panels being vertically orientated, each of the first and second lateral panels having an inner surface, an outer surface and a perimeter edge, wherein the perimeter edge includes a front edge and a rear edge positioned oppositely of each other; and the grip being attached to and extending between the inner surfaces of the first and second lateral panels, the grip being centrally located on the first and second lateral panels.

* * * * *